US006112409A

United States Patent [19]

Jaekel

[11] Patent Number: 6,112,409

[45] Date of Patent: Sep. 5, 2000

[54] ROLL FORMING UTILIZING SPLITTING TECHNOLOGY

[75] Inventor: Fred G Jaekel, Richmond Hill, Canada

[73] Assignee: Cosma International Inc., Ontario, Canada

[21] Appl. No.: 09/134,094

[22] Filed: Aug. 14, 1998

Related U.S. Application Data

[63] Continuation of application No. 08/970,584, Nov. 14, 1997, abandoned.

[51] Int. Cl.[7] ..... B21D 47/01

[52] U.S. Cl. ..... 29/897.35; 52/745.19; 72/204

[58] Field of Search ..... 29/897.35; 72/225, 72/204; 52/745.19

[56] References Cited

U.S. PATENT DOCUMENTS

| | | | |
|---|---|---|---|
| 939,168 | 11/1909 | Sack . | |
| 999,467 | 8/1911 | Sack . | |
| 1,068,467 | 7/1913 | Vassen . | |
| 1,076,784 | 10/1913 | Puppe . | |
| 1,544,776 | 7/1925 | Pugh . | |
| 1,812,248 | 6/1931 | Oberg . | |
| 3,722,052 | 3/1973 | Toti . | |
| 4,086,801 | 5/1978 | Nakajima et al. | 72/234 |
| 4,420,961 | 12/1983 | Kusaba et al. | 72/221 |
| 4,860,426 | 8/1989 | Engel et al. | 29/527.7 |
| 5,440,796 | 8/1995 | Deggau et al. | 29/412 |

FOREIGN PATENT DOCUMENTS

| | | |
|---|---|---|
| 57-142701 | 9/1982 | Japan . |
| 61-82903 | 4/1986 | Japan . |
| 61-135404 | 6/1986 | Japan . |
| 61-259801 | 11/1986 | Japan . |
| 6-297003 | 10/1994 | Japan . |

*Primary Examiner*—David P. Bryant
*Assistant Examiner*—Marc W. Butler
*Attorney, Agent, or Firm*—Pillsbury Madison & Sutro LLP

[57] ABSTRACT

A method is provided for roll-forming an I-beam structure having a web and a pair of opposing flanges at each end of the web. The method includes the steps of providing a flat blank having a thickness generally equal to a thickness of the web of the I-beam to be formed. The blank has a longitudinal axis, a central portion and opposing ends. Each of the blank ends is split along the longitudinal axis to form first and second flange portions at each of the ends. Each of the first and second flange portions has an edge directed away from the central portion. The flange portions are then bent about the longitudinal axis by moving each of the edges in a direction towards the central portion to form a mass of material at each of the blank ends. The mass of material is compacted at each of the blank ends to define the flanges. Each flange is disposed generally transverse with respect to the longitudinal axis and has a thickness generally equal to the thickness of the web.

13 Claims, 2 Drawing Sheets

ROLL FORMING UTILIZING SPLITTING TECHNOLOGY

This is a continuation of application Ser. No. 08/970,584, filed Nov. 14, 1997 now abandoned.

BACKGROUND OF THE INVENTION

1. Field of the Invention

The present invention relates to roll-forming structural members, and, in particular, to a method of roll-forming I-beams using splitting technology.

2. Background Information Roll-forming techniques have been employed to form structural members such as I-beams. One example of such a method includes providing a sheet blank having a thickness twice the thickness of the flanges of the I-beam which is to be ultimately formed. In a first roll stand, ends of the blank are split along the longitudinal axis thereof forming opposing flange portions at each end. The flange portions are then bent or straightened at each end of the blank in another roll stand so as to define the opposing flanges which are disposed generally transverse to the web or central portion of the I-beam. To achieve web and flange thicknesses which are generally equal, a further rolling operation must be performed on the web or central portion, between the flanges, reducing the thickness thereof to be equal to that of the flanges.

There is a continuing need to improve the method of roll-forming an I-beam structure such that the method is easy to perform and inexpensive to accomplish.

SUMMARY OF THE INVENTION

An object of the present invention is to fulfill a need referred to above. In accordance with the principles of the present invention, this objective is obtained by providing method of roll-forming an I-beam structure having a web and a pair of opposing flanges at each end of the web. The method includes the steps of providing a flat blank having a thickness generally equal to a thickness of the web of the I-beam to be formed. The blank has a longitudinal axis, a central portion and opposing ends. Each end of the blank is split along the longitudinal axis to form first and second flange portions at each of the blank ends. Each of the first and second flange portions has an edge directed away from the central portion. The flange portions are then bent about the longitudinal axis by moving each of the edges in a direction towards the central portion to form a mass of material at each of the blank ends. The mass of material is compacted at each of the blank ends to define the flanges. Each flange is disposed generally transverse with respect to the longitudinal axis and has a thickness generally equal to the thickness of the web.

Another object of the present invention is the provision of a method of the type described which is simple and economical to perform.

These and other objects of the invention will become apparent during the course of the following detailed description and the appended claims.

The invention may best be understood with reference to the accompanying drawings wherein an illustrative embodiment is shown.

BRIEF DESCRIPTION OF THE DRAWINGS

Referring now more particularly to the drawings, there is shown therein a series of successive roll stands employed in a method of the present invention. As shown in FIG. 1, the first roll stand, generally indicated at 10, includes a pair of identical, symmetrical horizontal rollers 12 and a pair of identical, symmetrical vertical rollers 14. Rollers 12 are mounted for rotation about axles 16, while rollers 14 are mounted for rotation about axles 18. The horizontal rollers 12 have working faces comprising a cylindrical surface 20. Similarly, the vertical rollers 14 have working faces comprising a cylindrical surface 22. The horizontal rollers 12 and vertical rollers 18 cooperate to form a blank 24 of material. The blank 24 has a longitudinal axis A, a central portion 26 and opposing ends 28. In the roll stand 10, the blank 24 is formed as a flat sheet having a thickness B equal to a thickness of the web of an I-beam to be ultimately formed. It can be appreciated that the blank 24 can be formed by process other than roll-forming in stand 10. A blank 24 need only be provided which has a thickness B generally equal to a thickness of the web of an I-beam to be ultimately formed. Thus, it can be appreciated that stand 10 may be only an alignment stand for a pre-formed blank for guiding the blank to downstream roll stands.

Figure 1:
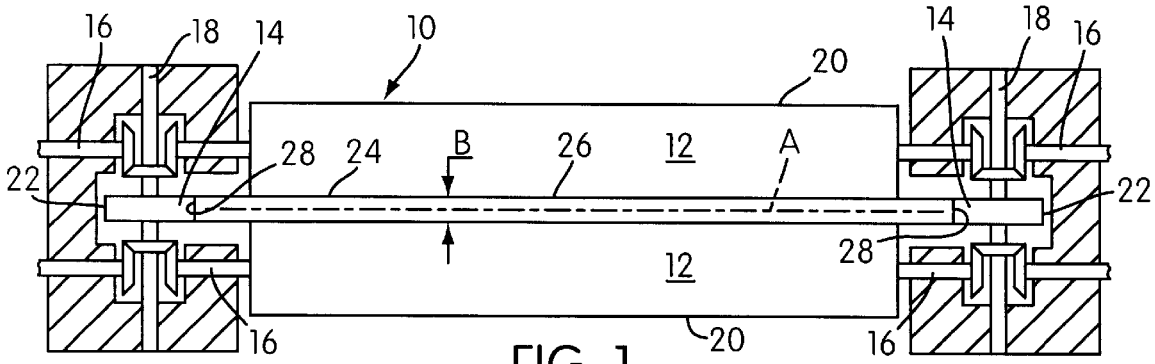
FIG. 1 is a schematic illustration of a roll stand, partially in section, for initially forming a flat blank of material.
Figure 2:
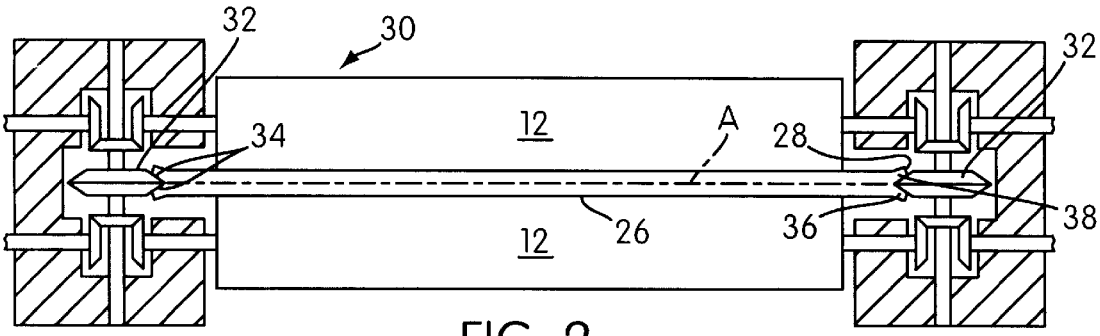
FIG. 2 is a view similar to FIG. 1 showing a roll stand having vertical rollers for performing an initial splitting operation at the ends of the blank.

Once the blank 24 is provided, the blank 24 is fed continuously through a series of successive roll stands to form the I-beam structure. In the illustrated embodiment, the blank 24 is conveyed to a roll stand 30 as shown in FIG. 2. Stand 30 is identical to the first stand 10 except that each vertical roller 32 has frusto-conical surfaces 34. Each roller 32 splits an associated end 28 along the longitudinal axis A of the blank 24, thereby forming a first flange portion 36 and a second flange portion 38 at each of the ends 28. The first and second flange portions 36 and 38, respectively, are inclined with respect to each other at an acute angle.

Figure 3:
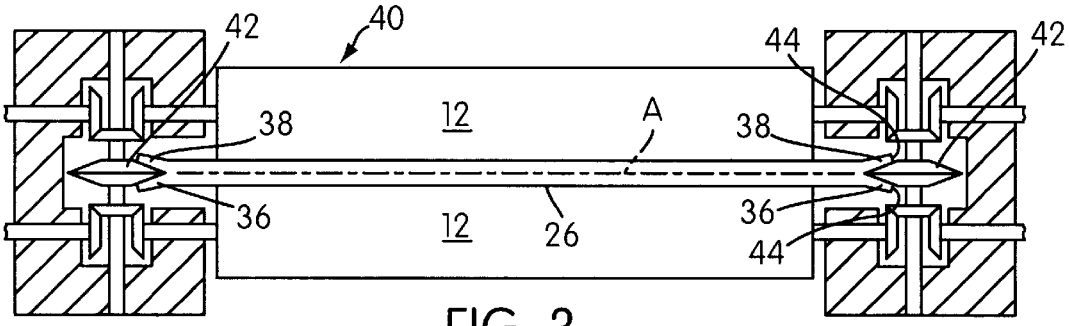
FIG. 3 is a view similar to FIG. 2 showing a stand having vertical rollers for further splitting the ends of the blank.

In the illustrated embodiment, the blank 24 is then conveyed to a roll stand 40, as shown in FIG. 3, which is similar to stand 30 and disposed downstream thereof. However, the vertical rollers 42 of stand 40 are shaped to split the ends 28 deeper than that shown in FIG. 2. The ends 28 are split so as to provide enough material to ensure that each of the I-beam flanges to be ultimately formed by the flange portions 36 and 38 has a thickness generally equal to the thickness B. As shown in FIG. 3, each of the flange portions 36 and 38 has a respective edge 44.

Figure 4:
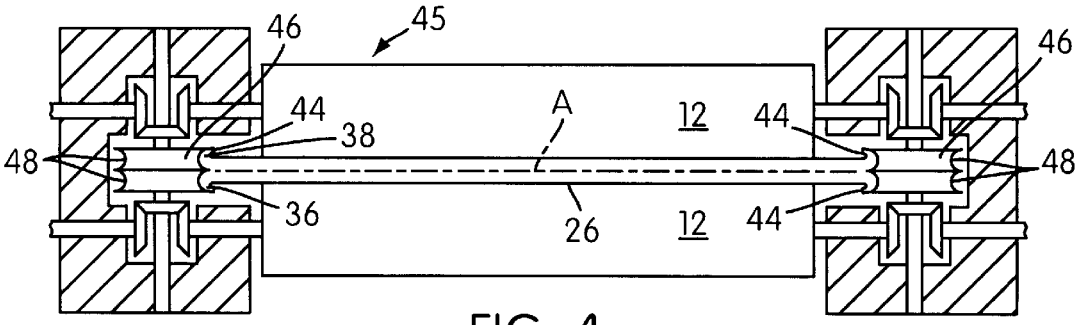
FIG. 4, is a view similar to FIG. 2 showing a roll stand having a pair of vertical rollers for initially bending flange portions at the ends of the blank.
Figure 5:
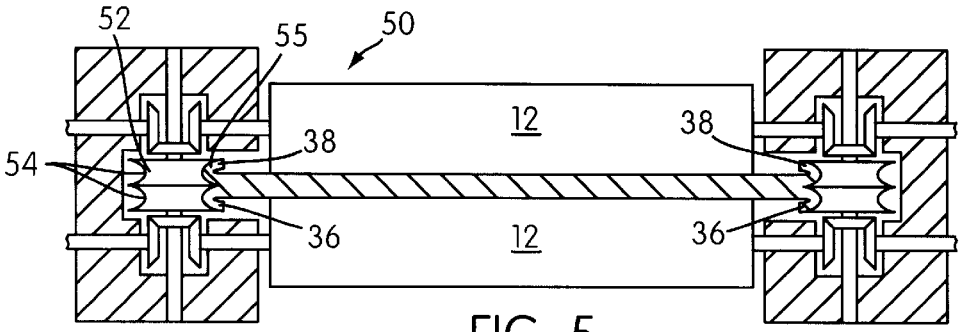
FIG. 5, is a view similar to FIG. 4, showing a roll stand wherein vertical rollers further bend the flange portions at the ends of the blank defining a mass of material at each end.

The blank 24 then proceeds to another roll stand 45, as shown in FIG. 4, disposed downstream of stand 40. In the illustrated embodiment, the stand 45 is identical to the stand 40, except that each of the vertical rollers 46 has a pair of working surfaces 48 of concave configuration. As shown, the rollers 46 bend the flange portions 36 and 38 about the longitudinal axis A such that the edges 44 of the flange portions are moved in a direction towards the central portion 26 of the blank 24.

In the illustrated embodiment, the blank 24 is then conveyed to roll stand 50 disposed downstream of stand 45. Stand 50 is generally identical to stand 45, except that each of the vertical rollers 52 has a pair working surfaces 54 of concave configuration, the concavity thereof being greater than that of the rollers 46. Thus, as shown, the flange portions 36 and 38 are bent further with respect to the longitudinal axis A thereby forming a mass of material 55 at each end of the blank 24. This is a thickening process that thickens the flange portions 36 and 38, which will ultimately become the I-beam flanges, as will become apparent below.

Figure 6:
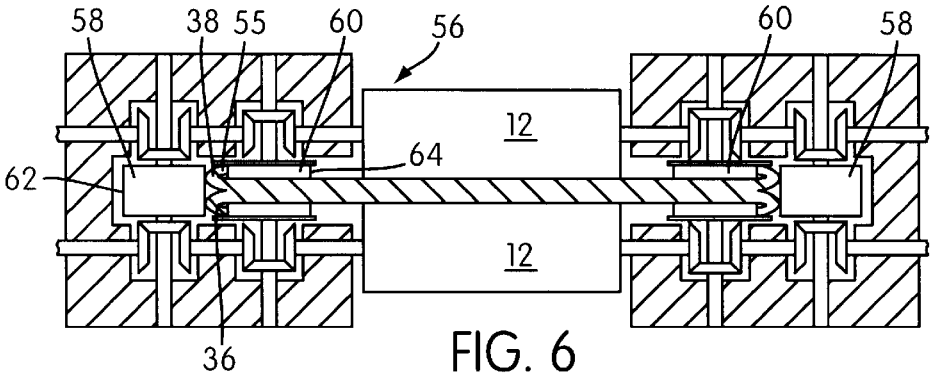
FIG. 6, is a schematic illustration, partially in section, showing a roll stand wherein vertical rollers initially compact the mass of material at each end of the blank.
Figure 7:
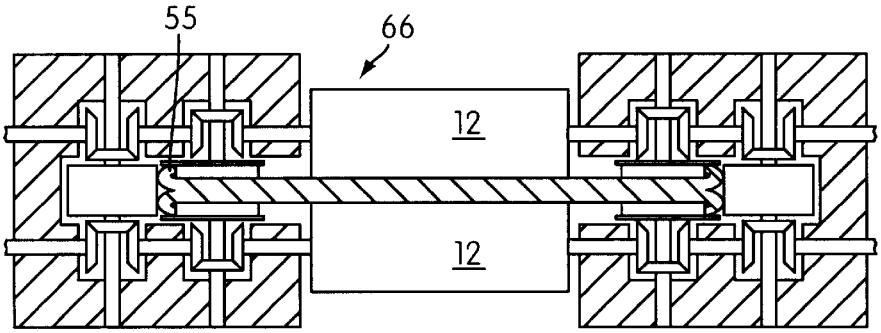
FIG. 7, is a view similar to FIG. 6, showing a roll stand wherein vertical rollers further compact the mass of material at each end of the blank.
Figure 8:
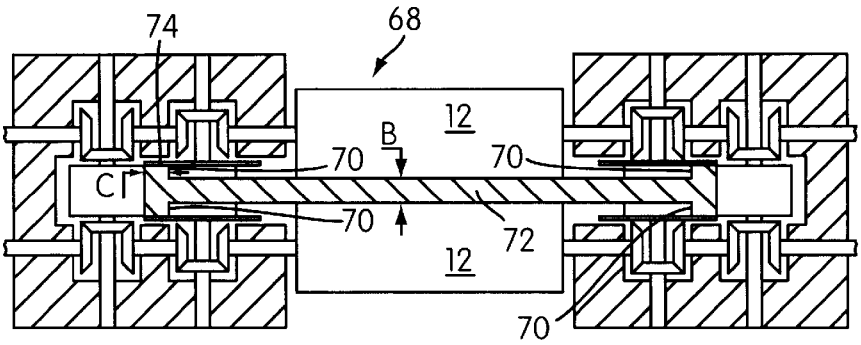
FIG. 8 is a view similar to FIG. 6 showing a roll stand having vertical rollers for further compacting the mass of material at each end of the blank to form flanges of an I-beam structure.

The blank 24 is then conveyed to the next stand 56, as shown in FIG. 6. Stand 56 is disposed downstream of stand 50 and includes a first pair of vertical rollers 58 and a second pair of back-up vertical rollers 60. Each roller 58 has a generally cylindrical working edge 62. Each roller 60 also has a generally cylindrical back-up edge 64. Rollers 58 and 60 cooperated to initially compact the mass of material 55 at each end of the blank 24.

The blank 24 is then moved through roll stand 66 which further compacts the mass of material 55. Finally, the blank 24 is directed through a stand 68 whereby the flange portions are compacted to a point to define solid, opposing flanges 70 of the I-beam structure at each end of the web 72. As shown, each of the flanges 70 of the I-beam is disposed generally transverse to the longitudinal axis A and has a thickness C which is generally equal to the thickness B of the web 72. Further, ends 74 of each of the flanges 70 are formed in the roll stand 68 so as to be generally parallel to axis A. This completes forming the I-beam and the I-beam can be cut to the desired length.

It can be appreciated that the roll stands shown are exemplary only. The roll stands may be of any construction and arrangement suitable to split, bend and compact the ends of the blank to form the flanges 70. Further, the number of stages used to form the I-beam is exemplary. For example, a plurality of intermediate stages may be employed or certain stages may be combined.

It can be seen that the invention provides an effective method of roll-forming an I-beam by continuously conveying a blank of material through a series of roll stands. The I-beam structure formed includes flanges having a thickness generally equal to a thickness of the web. The ability to form the flanges having the same thickness as the web without additional forming of the web advantageously reduces manufacturing costs.

It thus will be seen that the objects of this invention have been fully and effectively accomplished. It will be realized, however, that the foregoing preferred embodiment of the present invention has been shown and described for the purposes of illustrating the structural and functional principles of the present invention and is subject to change without departure from such principles. Therefore, this invention includes all modifications encompassed within the spirit of the following claims.

What is claimed is:

1. A method of roll-forming an I-beam structure having a web and a pair of opposing flanges at each end of the web, the method including the sequential steps of:

providing a flat blank having a thickness generally equal to a thickness of the web of the I-beam to be formed, said blank having said thickness thereof defined by opposite surfaces and terminating in opposite longitudinal ends, said blank having a longitudinal axis extending longitudinally through the thickness of said blank, splitting the thickness of said blank at each of said opposite longitudinal ends of said blank to form first and second flange portions at each of said longitudinal blank ends, such that the flange portions comprise sufficient material to produce flanges having a thickness generally equal to the thickness of the blank and of the web upon compacting, said first and second flange portions having respective edges disposed on opposite sides of said longitudinal axis, first moving said flange portions while in their split thickness into respective arcuate configurations so that said opposite surfaces at said first and second flange portions have concave configurations, after said first moving step in which said opposite surfaces at said first and second flange portions are provided with said concave configurations, then moving said first and second flange portions so that they are doubled over themselves and bent back so as to extend back towards said web; and compacting each of said bent back flange portions of said split thickness to form respective flanges on opposite sides of said longitudinal axis having a generally constant thickness, which thickness is generally equal to the thickness of the blank and of the web, said flanges disposed generally transverse with respect to said longitudinal axis.

2. The method according to claim 1, wherein the splitting step includes splitting the ends of the blank an amount so as to provide enough material to ensure that the thickness of the flanges is generally equal to the thickness of the web upon the completion of said compacting step.

3. The method according to claim 1, wherein the splitting step includes initially splitting the ends of the blank, and thereafter splitting the ends of the blank a further amount to provide enough material so as to ensure that the thickness of the flanges is generally equal to the thickness of the web upon the completion of said compacting step.

4. The method according to claim 1, wherein said first moving step includes initially bending the flange portions a first amount and then bending the flange portions a second, greater amount to provide said flange portions with said arcuate configurations.

5. The method according to claim 1, wherein said compacting step includes forming edges of each of said flanges so as to be generally parallel to said longitudinal axis.

6. The method according to claim 1, wherein said splitting step includes initially splitting each of said ends of the blank using at least a first pair of vertical rollers with one roller of said pair being associated with a respective end of said blank, each said roller of said pair having frusto-conical surfaces to facilitate the splitting step.

7. The method according to claim 6, wherein said splitting step includes further splitting each of said ends of the blank after said initial splitting, using a second pair of vertical rollers, each roller of said second pair of rollers having frusto-conical surfaces.

8. The method according to claim 1, wherein said first moving step includes initially bending each of said ends of the blank using at least a first pair of vertical rollers, each roller of said pair having a pair of concave surfaces to facilitate the bending step.

9. The method according to claim 8, wherein said first moving step includes further bending each of said ends of the blank after said initial bending using a second pair of vertical rollers, each roller of said second pair of rollers having a pair of concave surfaces of concavity greater than a concavity of the concave surfaces of each of said first pair of rollers, and wherein said moving step after first moving step is accomplished with a third pair of rollers having a pair of concave surfaces of concavity greater than a concavity of the concave surfaces of each of said second pair of rollers.

10. The method according to claim 1, further comprising the step of cutting the formed I-beam structure to a particular size.

11. The method according to claim 1, wherein said step (v) further comprises moving each of said flange portions of said split thickness and said arcuate configuration through cooperating rollers to flatten and increase the thickness of said flange portions until said flange portions form said flanges of generally equal thickness to said web.

12. The method according to claim 11 where during said step (iv), said edges of said flange portions first move away from said longitudinal axis and then move toward said longitudinal axis to provide said respective arcuate configurations.

13. A method of roll-forming an I-beam structure using a series of successive roll stands in a roll-forming process, the I-beam structure having a web and a pair of opposing flanges at each end of the web, the method including the sequential steps of:

(i) providing a flat sheet having a thickness generally equal to a thickness of the web, said blank having said thickness thereof defined by opposite surfaces and terminating in opposite longitudinal ends, said sheet having a longitudinal axis extending longitudinally through the thickness of said blank, (ii) roll-forming first and second flange portions at each of the ends of the sheet to split the thickness of each of said sheet ends a predetermined amount along the longitudinal axis, such that the flange portions comprise sufficient material to produce flanges having a thickness generally equal to the thickness of the blank and of the web upon compacting, and so that each of said first and second flange portions have respective edges thereof disposed on opposite sides of said longitudinal axis, (iii) roll-forming said flange portions while in their split thickness into respective arcuate configurations so that said opposite surfaces are provided with concave configurations at said first and second flange portions, and (iv) after step (iii), roll-forming said first and second flange portions so that they are doubled over themselves and bent back so as to extend back towards said web; and (v) roll-forming said bent back flange portions of said split thickness to compact said flange portions and thereby form respective flanges having a generally constant thickness, which thickness is generally equal to the thickness of the web and disposed generally transverse with respect to said longitudinal axis.

* * * * *